US007683591B2

(12) United States Patent
Sadayuki et al.

(10) Patent No.: US 7,683,591 B2
(45) Date of Patent: Mar. 23, 2010

(54) SEMICONDUCTOR DEVICE WITH VOLTAGE VARIATION DETECTOR

(75) Inventors: Eiichi Sadayuki, Osaka (JP); Jun Horikawa, Shiga (JP)

(73) Assignee: Panasonic Corporation, Osaka (JP)

( * ) Notice: Subject to any disclaimer, the term of this patent is extended or adjusted under 35 U.S.C. 154(b) by 412 days.

(21) Appl. No.: 10/584,620

(22) PCT Filed: Nov. 10, 2004

(86) PCT No.: PCT/JP2004/016644

§ 371 (c)(1),
(2), (4) Date: Jun. 26, 2006

(87) PCT Pub. No.: WO2005/066733

PCT Pub. Date: Jul. 21, 2005

(65) Prior Publication Data

US 2007/0146017 A1 Jun. 28, 2007

(30) Foreign Application Priority Data

Dec. 26, 2003 (JP) ..... 2003-434075

(51) Int. Cl.
*G05F 1/00* (2006.01)

(52) U.S. Cl. ..... 323/272; 324/433

(58) Field of Classification Search ..... 323/272, 323/271; 324/428, 433, 677, 678, 705, 713, 324/771

See application file for complete search history.

(56) References Cited

U.S. PATENT DOCUMENTS

| | | | | |
|---|---|---|---|---|
| 4,103,638 | A * | 8/1978 | Fowler | 114/144 E |
| 4,320,338 | A * | 3/1982 | Morris et al. | 324/678 |
| 4,633,168 | A * | 12/1986 | Venema | 324/678 |
| 4,841,227 | A * | 6/1989 | Maier | 73/304 C |
| 5,274,334 | A * | 12/1993 | Mills | 324/678 |
| 5,886,565 | A | 3/1999 | Yasui et al. | 327/530 |
| 6,087,885 | A * | 7/2000 | Tobita | 327/379 |
| 6,118,295 | A | 9/2000 | Murayama et al. | 324/771 |
| 6,137,702 | A * | 10/2000 | Hall et al. | 363/95 |
| 6,229,775 | B1 * | 5/2001 | Park | 369/47.52 |
| 6,271,650 | B1 * | 8/2001 | Massie et al. | 323/272 |
| 6,316,948 | B1 * | 11/2001 | Briefer | 324/678 |
| 6,577,109 | B2 * | 6/2003 | Dancy et al. | 323/272 |
| 6,580,258 | B2 * | 6/2003 | Wilcox et al. | 323/282 |
| 6,646,503 | B2 | 11/2003 | Allinger et al. | 330/69 |
| 2003/0226082 | A1 | 12/2003 | Kim et al. | 714/734 |

(Continued)

FOREIGN PATENT DOCUMENTS

| | | | |
|---|---|---|---|
| CN | 1427954 | A | 7/2003 |

(Continued)

*Primary Examiner*—Edward Tso
*Assistant Examiner*—Arun Williams
(74) *Attorney, Agent, or Firm*—Steptoe & Johnson LLP

(57) ABSTRACT

A semiconductor device includes a comparator which includes two input terminals and compares the voltage values between the power supply voltage which is inputted to one side input terminal and the reference voltage which is inputted to the other side input terminal. A resistor element connects two signal lines that are connected to the input terminals of the comparator One end of a capacitance element is connected to a power supply terminal for applying a power supply and the other end is connected to one input terminal of the comparator.

6 Claims, 12 Drawing Sheets

U.S. PATENT DOCUMENTS

2005/0146378 A1* 7/2005 Ozeki et al. ..... 327/541

FOREIGN PATENT DOCUMENTS

| | | |
|---|---|---|
| EP | 1 160 580 | 5/2001 |
| JP | 51-39433 | 3/1976 |
| JP | 3-5634 | 1/1991 |
| JP | 6-152358 | 5/1994 |
| JP | 8-79901 | 3/1996 |
| JP | 10-105258 | 4/1998 |
| JP | 2002-251301 | 9/2002 |
| JP | 2003-185692 | 7/2003 |
| WO | WO 01/88560 | 11/2001 |

* cited by examiner

PRIOR ART

PRIOR ART

SEMICONDUCTOR DEVICE WITH VOLTAGE VARIATION DETECTOR

CLAIM OF PRIORITY

This application claims priority under 35 USC 371 to International Application No. PCT/JP2004/016644, filed on Nov. 10, 2004, which claims priority to Japanese Patent Application No. 2003-434075, filed on Dec. 26, 2003, each of which is incorporated by reference in its entirety.

TECHNICAL FIELD

The present invention relates to a semiconductor device and, more particularly, to a semiconductor device provided with a power supply voltage variation detection circuit which detects steep variations of the voltage difference between the, power supply voltage and the reference voltage.

BACKGROUND ART

Hereinafter, a conventional semiconductor device provided with a power supply variation detecting circuit will be described with reference to FIG. 11(refer to Patent Reference No. 1). As shown in FIG. 11, the semiconductor device is provided with two resister elements 103-106 between the power supply terminal 101 and the ground terminal 102. Further, it is provided with two-input comparators 107, 108. The comparator 107 receives an input from an one side input terminal that is obtained by dividing the power supply voltage 109 by the resister elements 105 and 106, and receives the reference voltage 112 from the other side input terminal. Further, there is provided a capacitance element 118 between a signal line connecting the one side terminal of the comparator 107 and the node 113 and the power supply terminal 116. Further, there is provided a logic AND circuit 119 operating output signals of the comparator 107, 108.

In the semiconductor device constituted as above, by comparing the divided power supply voltage 109 and the reference voltage 110 by the comparator 107, variations at positive side of the power supply voltage is detected, and by comparing the divided power supply voltage 111 and the reference voltage 112, variations at negative side of the power supply voltage is detected. When the power supply voltage varies toward the positive side, the voltage variations are capacitance-coupled by the capacitance element 117, and thereby the power supply voltage which is inputted to the one side input of the comparator 107 is varied, thereby becoming a reference voltage. The comparator 107 detects the voltage difference, and outputs a signal indicating t hat effect. Similarly, when the power supply voltage varies toward the negative side, the comparator 108 detects the voltage difference, and outputs a signal indicating that effect. The output signals of the comparators 107, and 108 are calculated by the logic AND circuit 119. By such a construction, the semiconductor device can output a logic signal indicating that the power supply voltage variation is detected.

Further, another conventional semiconductor device which is provided with a power supply voltage variation detection circuit will be described with reference to FIG. 12 (Patent Reference No. 2). In this semiconductor device, there are two inverter circuits 201, 202 which receive power supply voltage and ground voltage as inputs, and the output of the first stage inverter circuit 201 and the input of the second stage inverter circuit 202 are connected via the integration delay circuit comprising the resister element 203 and the capacitance element 204, and the output of the second stage inverter circuit 202 is connected to the input of the first stage inverter circuit 201. Thereby, when the voltage difference between the power supply voltage and the ground voltage varies steeply, the initial value which is previously stored is reversed, thereby outputting a logic signal indicating a steep increase or fall down of the voltage difference.

Patent reference No. 1: EP1160580A1

Patent reference No. 2: Japanese Published Patent Application Hei. 6-152358(page 7, FIG. 3)

DISCLOSURE OF THE INVENTION

The Problems to be Solved by the Invention

In the prior art semiconductor device described above, there is a problem that the detection level of the steep power supply voltage variation depends on the voltage value before voltage variation, i.e., the power supply voltage value at a normal state. For example, in the semiconductor device shown in FIG. 11, when the voltage variation at negative side is detected, if the power supply voltage value before the variation is low, only a small voltage variation by slight noises are detected as abnormal, and therefore, there is a possibility that the voltage variation which would not affect the operation of the semiconductor device should be detected as abnormal. In addition, when the power supply voltage before variations is high, there is a possibility that abnormality is detected only when a relatively large voltage variation arises.

Also for the semiconductor device shown in FIG. 12, there are similar problems as in the semiconductor device shown in FIG. 11, because the detection level of the power supply voltage variation depends on the voltage value before the voltage variation occurs.

From the above, in the prior art semiconductor device, it is necessary to consider not only the variation of the power supply voltage but also the value of the power supply voltage before variation when designing a circuit for detecting the power supply voltage variations. This results in a lot of parameters to be considered in designing, and also it has also become difficult in a circuit designing.

Therefore, it is an object of the present invention to provide a semiconductor device provided with a circuit for detecting variations in the power supply voltage, which can detect steep variations in the power supply voltage without depending on the power supply voltage before the voltage variations.

Measures to Solve the Problems

In order to solve the above-described problems, there is provided a semiconductor device according to Claim 1 of the present invention which comprises: a capacitance element one end of which is connected to a power supply voltage; a first comparator which has two input nodes having opposite polarity to each other and receives a reference voltage and an output of other end of the capacitance element at their inputs to compare the respective voltage values to output a signal indicating a comparison result; a first resister element which connects the one side input node and the other side input node of the first comparator; and the first comparator activates the output signal indicating the comparison result when the voltage difference between the inputted reference voltage and the inputted output of other end of the capacitance element occurs.

A semiconductor device according to Claim 2 of the present invention comprises, in a semiconductor device as defined in claim 1, the first comparator comprising a hysteresis comparator which activates the output signal indicating the comparison result when the voltage difference between the inputted reference voltage and the inputted output of other end of the capacitance element becomes larger than a predetermined hysteresis width.

A semiconductor device according to claim 3 of the present invention comprises, in a semiconductor device as defined in claim 1, further a second and a third resister element connected in series between the power supply voltage and the ground terminal to divide the power supply voltage; a second comparator having two input nodes and receives the voltage divided by the second and the third resister element and the reference voltage at its inputs to compare those; and a logic OR circuit which takes a logic OR operation of the output signal of the first comparator and the output signal of the second comparator.

A semiconductor device according to claim 4 of the present invention comprises, in a semiconductor device as defined in claim 3, further a reset portion which receives the output signals of the first comparator or the logic OR circuit at their inputs, and the stops the operation of the system including the semiconductor device when the output signal of the first comparator or the output signal of the second comparator is activated.

A semiconductor device according to claim 5 of the present invention comprises, in a semiconductor device as defined in claim 3, further a switching part which switches the value of the output of other end of the capacitance element which is inputted to either of the input nodes of the first comparator to an arbitrary value.

A semiconductor device according to claim 6 of the present invention comprises, in a semiconductor device as defined in claim 5, further a control section which operates the switching part at turning on the power of the semiconductor device.

A semiconductor device according to claim 7 of the present invention comprises: a first and a second capacitance elements one end of which is connected to a power supply voltage; a first comparator which has two input nodes having opposite polarity to each other and receives a reference voltage and an output of other end of the first capacitance element at their inputs to compare the respective voltage values to output a signal indicating a comparison result; a second comparator which has two input nodes having opposite polarity to each other and receives a reference voltage and an output of other end of the second capacitance element at their inputs to compare the respective voltage values to output a signal indicating a comparison result; a first and a second resister elements each of which connects the one side input node and the other side input node of the first and the second comparators, respectively; a logic OR circuit which takes a logic OR operation of the output signal of the first comparator and the output signal of the second comparator: the first and the second comparators respectively activate the output signal indicating the comparison results when the voltage difference between the inputted reference voltage and the inputted output of other end of the capacitance element occurs, and the polarity of the input node which receives the output of other end of the first capacitance element in the first comparator and the polarity of the input node which receives the output of other end of the second capacitance element in the second comparator are opposite to each other.

A semiconductor device according to claim 8 of the present invention comprises, in a semiconductor device as defined in claim 7, further the first comparator and the second comparator respectively being hysteresis comparators which activates the output signal indicating the comparison result when the voltage difference between the inputted reference voltage and the inputted output of other end of the first capacitance element is larger than a predetermined hysteresis width.

A semiconductor device according to claim 9 of the present invention comprises, in a semiconductor device as defined in claim 7, further a third and a fourth resister elements connected in series between the power supply voltage and the ground terminal to divide the power supply voltage, and a third comparator which has two input nodes and compares the voltage which is divided by a third and a fourth resister elements and the reference voltage to output a signal indicating the comparison result to the logic OR circuit.

A semiconductor device according to claim 10 of the present invention comprises, in a semiconductor device as defined in claim 9, further a reset part which receives the output signal of the logic OR circuit at its input and stops the operation of a system including the semiconductor device when the output signal of the first comparator, the second comparator, or the third comparator is activated.

A semiconductor device according to claim 11 of the present invention comprises, in a semiconductor device as defined in claim 9, further a switching part which switches the value of the output of other end of the first capacitance element which is inputted to either of the input nodes of the first comparator and the value of the output of other end of the second capacitance element which is inputted to either of the input nodes of the second comparator to an arbitrary value.

A semiconductor device according to claim 12 of the present invention comprises, in a semiconductor device as defined in claim 11, further a control section which operates the switching part at turning on the power of the semiconductor device.

Effects of the Invention

Since in order to solve the above-described problems, a semiconductor device according to Claim 1 of the present invention which comprises: a capacitance element one end of which is connected to a power supply voltage; a first comparator which has two input nodes having opposite polarity to each other and receives a reference voltage and an output of other end of the capacitance element at their inputs to compare the respective voltage values to output a signal indicating a comparison result; a first resister element which connects the one side input node and the other side input node of the first comparator; and the first comparator activates the output signal indicating the comparison result when the voltage difference between the inputted reference voltage and the inputted output of other end of the capacitance element occurs, the voltage variations can be detected regardless of the power supply voltage value before the voltage variations. As a result, with relative to the prior art semiconductor device, the parameters which should be considered on designing are reduced, and the circuit design is simplified.

Since the semiconductor device according to Claim 2 of the present invention comprises, in a semiconductor device as defined in claim 1, the first comparator comprising a hysteresis comparator which activates the output signal indicating the comparison result when the voltage difference between the inputted reference voltage and the inputted output of other end of the capacitance element becomes larger than a predetermined hysteresis width, the variations in the power supply voltage which does not affect on the operation of the semiconductor device may not be erroneously detected as abnormal voltage variations.

Since a semiconductor device according to claim 3 of the present invention comprises, in a semiconductor device as defined in claim 1, further a second and a third resister element connected in series between the power supply voltage and the ground terminal to divide the power supply voltage; a second comparator having two input nodes and receives the voltage divided by the second and the third resister element and the reference voltage at its inputs to compare those; and a logic OR circuit which takes a logic OR operation of the output signal of the first comparator and the output signal of the second comparator, not only the steep voltage variations but also smoothly varying voltage variations can be detected.

Since a semiconductor device according to claim 4 of the present invention comprises, in a semiconductor device as defined in claim 3, further a reset portion which receives the output signals of the first comparator or the logic OR circuit at their inputs, and stops the operation of the system including the semiconductor device when the output signal of the first comparator or the output signal of the second comparator is activated, even if attacks such as falsification of data or unjustified reading out is carried out by steeply changing the power supply voltage, this is automatically detected to conduct a reset and thus it is possible to take countermeasures against such attacks.

Since a semiconductor device according to claim 5 of the present invention comprises, in a semiconductor device as defined in claim 3, further a switching part which switches the value of the output of other end of capacitance element which is inputted to either of the input nodes of the first comparator to an arbitrary value, it is possible t confirm whether the comparator is operating normally.

Since a semiconductor device according to claim 7 of the present invention comprises: a first and a second capacitance elements one end of which is connected to a power supply voltage; a first comparator which has two input nodes having opposite polarity to each other and receives a reference voltage and an output of other end of the first capacitance element at their inputs to compare the respective voltage values to output a signal indicating a comparison result; a second comparator which has two input nodes having opposite polarity to each other and receives a reference voltage and an output of other end of the second capacitance element at their inputs to compare the respective voltage values to output a signal indicating a comparison result; a first and a second resister elements each of which connects the one side input node and the other side input node of the first and the second comparators, respectively; a logic OR circuit which takes a logic OR operation of the output signal of the first comparator and the output signal of the second comparator: the first and the second comparators respectively activate the output signal indicating the comparison results when the voltage difference between the inputted reference voltage and the inputted output of other end of the capacitance element occurs, and the polarity of the input node which receives the output of other end of the first capacitance element in the first comparator and the polarity of the input node which receives the output of other end of the first capacitance element in the second comparator are opposite to each other, the voltage variations at positive side and at the negative side can be detected without dependent on the power supply voltage value before the voltage variation. As a result, with relative to the prior art device, the parameters which should be considered in designing can be reduced, and the circuit designing is eased.

Since a semiconductor device according to claim 8 of the present invention comprises, in a semiconductor device as defined in claim 7, further the first comparator and the second comparator respectively being hysteresis comparators which activates the output signal indicating the comparison result when the voltage difference between the inputted reference voltage and the inputted output of other end of the first capacitance element is larger than a predetermined hysteresis width, it may not occur that variations in the power supply voltage which do not affect the operation of the semiconductor device should be erroneously detected as abnormal voltage variation. Or it may not occur that variations in the power supply voltage which do not affect on the operation of the semiconductor device should be erroneously detected as abnormal voltage variation.

Since a semiconductor device according to claim 9 of the present invention comprises, in a semiconductor device as defined in claim 7, further a third and a fourth resister elements connected in series between the power supply voltage and the ground terminal to divide the power supply voltage, and a third comparator which has two input nodes and compares the voltage which is divided by a third and a fourth resister elements and the reference voltage to output a signal indicating the comparison result to the logic OR circuit, not only the steep voltage variations but also smoothly varying voltage variations can be detected.

Since a semiconductor device according to claim 10 of the present invention comprises, in a semiconductor device as defined in claim 9, further a reset part which receives the output signal of the logic OR circuit at its input and stop the operation of a system including the semiconductor device when the output signal of the first comparator, the second comparator, or the third comparator is activated, even when attacks such as falsification of data or unjustified reading out is carried out by steeply changing the power supply voltage, this is automatically detected to conduct a reset and this it is possible to take countermeasures against such attacks.

Since a semiconductor device according to claim 11 of the present invention comprises, in a semiconductor device as defined in claim 9, further a switching part which switches the value of the output of other end of the first capacitance element which is inputted to either of the input nodes of the first comparator and the value of the output of other end of the second capacitance element which is inputted to either of the input nodes of the second comparator to an arbitrary value, it is possible to confirm whether the comparator is operating normally.

BRIEF DESCRIPTION OF THE DRAWINGS

FIG. 5 is a diagram illustrating a circuit construction of a semiconductor device according to a third embodiment of the present invention.

DESCRIPTION OF NUMERALS

Figure 1:
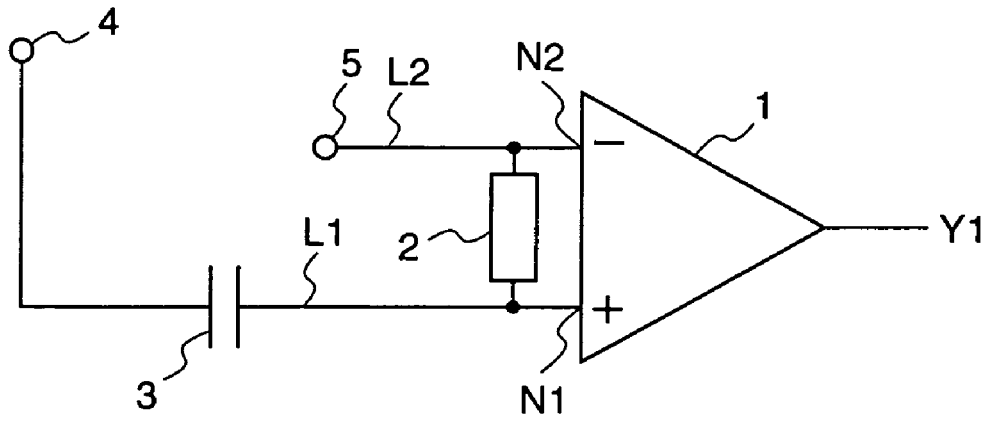
FIG. 1 is a diagram illustrating a circuit construction of a semiconductor device according to a first embodiment of the present invention.

1, 11 comparator
2, 8, 12, 13 resister element
3, 9 capacitance element
4 power supply voltage
5 input terminal of a reference voltage
6, 7 hysteresis comparator
10, 14 logic OR circuit
15 switching part
16 inverter
17 p channel transistor
18 n channel transistor
IN1 input terminal of an arbitrary voltage
N1, N2, N7, N8 input terminals of the comparators
N3~N6 input terminals of the hysteresis comparators
Y1~Y5 detected signal
101, 115, 115 power supply terminal
102 ground terminal
103, 104, 105, 106, 203 resister element
107, 108 comparator
109, 111 divided voltage
110, 112 reference voltage
117, 118, 204 capacitance element
119 logic AND circuit
201, 202 inverter
205 input line
206 output line
207 power supply voltage variation detection outputting line

BEST MODE FOR EMBODYING THE INVENTION

Hereinafter, preferred embodiments of the present invention will be described with reference to the drawings.

Embodiment 1

A semiconductor device according to a first embodiment of the present invention will be described with reference to FIGS. 1 and 2.

Figure 2:
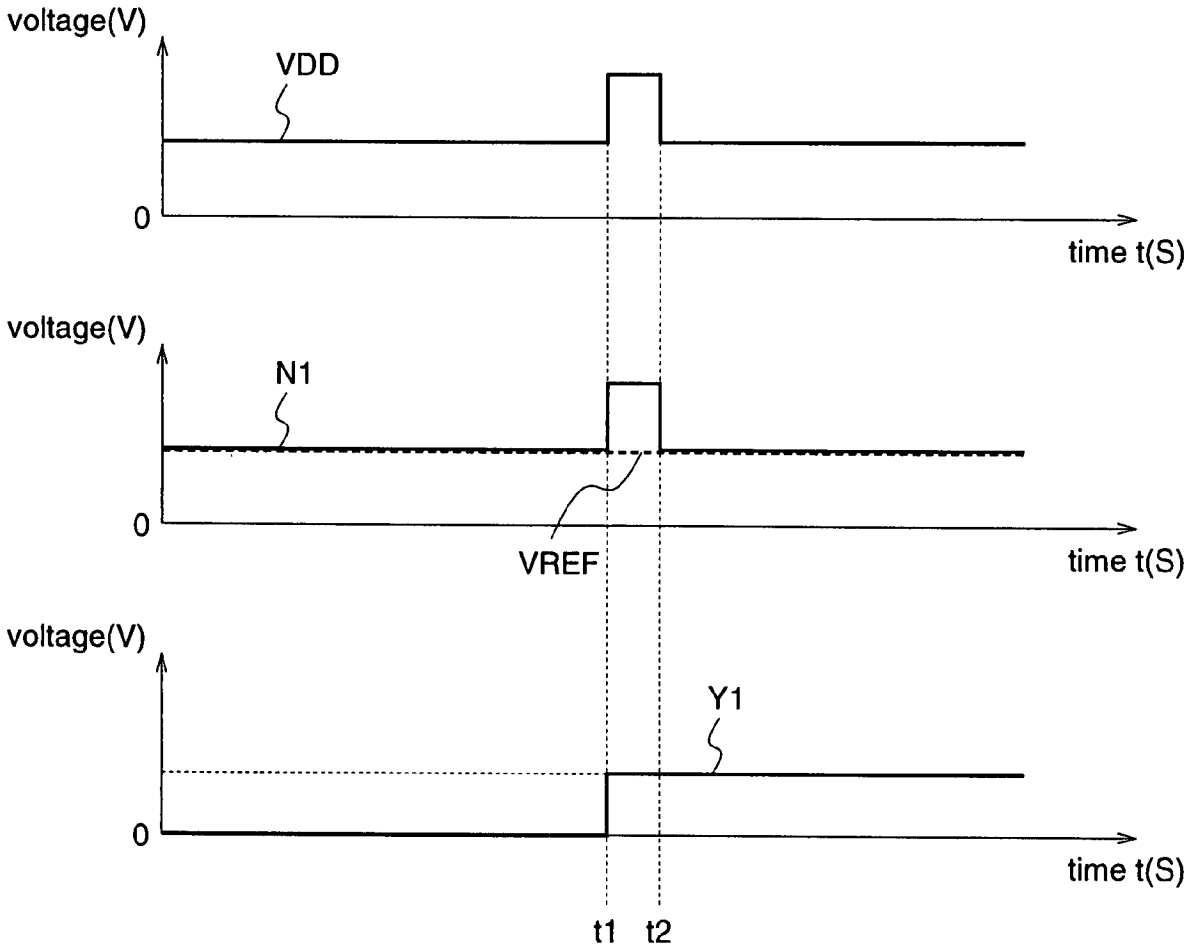
FIG. 2 is a diagram showing a timing chart exemplifying the operation of the semiconductor device according to the first embodiment of the present invention.

FIG. 1 is a diagram illustrating a circuit construction of a semiconductor device according to a first embodiment of the present invention. The semiconductor device shown in FIG. 1 includes a comparator 1, a resister element 2, and a capacitor element 3. The comparator 1 has two input terminals (input terminals N1 and N2). The capacitor element 3 has its one side end which is connected to the power supply voltage 4 and its other side end which is connected to one side input terminal (input terminal N1) of the comparator 1 via the signal line L1. The input terminal 5 of the reference terminal is connected to the other side input terminal (input terminal N2) of the comparator 1 via the signal line L2. The comparator 1 receives the reference voltage and an output of the other end side of capacitance 3 to compare those. The resister element connects between the signal line L1 which is connected to the input terminal N1 and the signal line L2 which is inputted to the input terminal N2 of the comparator 1.

Besides, in FIG. 1, both of the input terminal N1 (N2) and the signal line L1 (L2) which is connected thereto may be considered as input nodes, and only the input terminal N1 (N2) may be considered as input nodes. Accordingly, the resister element 2 may be connected between the input terminals N1, N2 of the comparator 1 only via either one of the signal lines L1 and L2, or it may be directly connected between the input terminals N1, N2.

The operation of the semiconductor device constructed as above, will be described with reference to FIG. 2. FIG. 2 is a timing chart exemplifying the operation of the semiconductor device shown in FIG. 1. In FIG. 2, VDD denotes a power supply voltage, VREF denotes a reference voltage, and Y1 denotes a detection signal which is an output of the comparator 1.

First of all, at time to, the power supply voltage 4 (the power supply voltage VDD) is applied, and a reference voltage VREF is applied. Then, the voltages which are inputted to the input terminal N1, N2 of the comparator 1 are equal to each other by the resister element 2.

Next, it is supposed that a positive side voltage variation is generated at the power supply voltage VDD during from time t1 to time t2. Then, the voltage variation component is capacitance-coupled by the capacitance element 3, and thereby the voltage which is inputted to the input terminal N1 of the comparator 1 also varies to become a voltage higher than the reference voltage VREF. This voltage difference is amplified by the comparator 1 to make the detected signal Y1 transit from low level to high level, and thereby a high level detected signal Y1 is outputted. This high level detected signal Y1 is inputted to the reset part (not shown), and this reset part stops the operation of the whole system including the semiconductor device(for example, an LSI). Accordingly, even if attacks such as falsification of data or unjustified reading out is carried out by steeply changing the power supply voltage, this is automatically detected to conduct a reset and thus it is possible to take countermeasures against such attacks. Also, this detection can be carried out without depending on the power supply voltage value before the power supply voltage variation.

As described above, a semiconductor device according to the first embodiment of the present invention can provide the following effects. That is, while the prior art semiconductor device the detection level of the voltage variation depends on the power supply voltage value because simply the power supply voltage is divided by the resister element and the voltage which was divided by the resister elements is compared with the reference voltage, in the semiconductor device according to the first embodiment of the present invention, the detection level of the voltage variation does not depend on the power supply voltage value before the voltage variation because the voltage variation from the state where the value of the output of other end side of the capacitance element 3 has one side which is connected to the power supply voltage and the reference voltage is made the same value by the resister element 2. As a result, with relative the prior art semiconductor device, parameters which should be considered in designing are reduced, and the circuit design is eased.

While in the above-described first embodiment the operation of detecting the voltage variation at positive side is detected, the voltage variation at negative side can also detected by making the polarity of the input terminal N1 and the input terminal N2 of the comparator 1 reverse to each other, i.e., making the input terminal N1 a reverse phase input terminal (hereinafter referred to as "− terminal") and making the input terminal N2 as a positive phase input terminal (hereinafter referred to as a "+ terminal").

Embodiment 2

Figure 3:
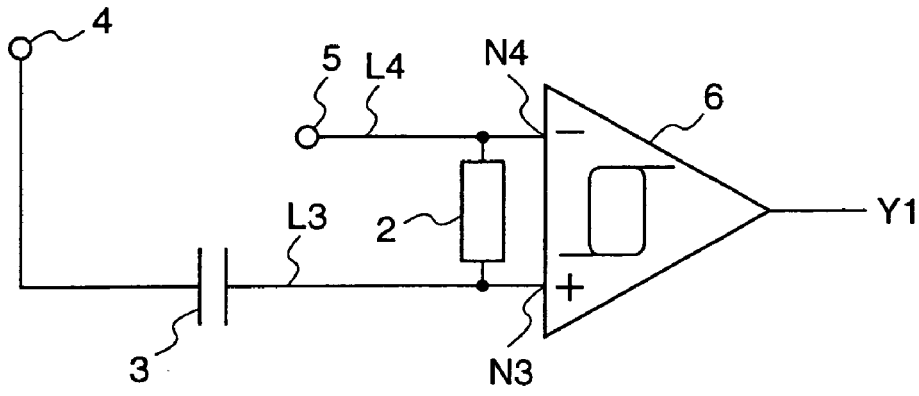
FIG. 3 is a diagram illustrating a circuit construction of a semiconductor device according to a second embodiment of the present invention.

A second embodiment of the present invention will be described with reference to FIGS. 3 and 4. FIG. 3 is a diagram illustrating a circuit construction of a semiconductor device according to the second embodiment of the present invention. The semiconductor device shown in FIG. 3 is characterized in that a hysteresis comparator 6 is provided in place of a comparator 1 in the semiconductor device shown in FIG. 1. Besides, the components similar to those in the semiconductor device shown in FIG. 1 are assigned with the same reference numerals and the description is omitted here.

The hysteresis comparator 6 outputs a high detected signal Y1 when the difference between the reference voltage and the output of the capacitance element 3 which are two input terminals (input terminal N3 and N4) is larger than the hysteresis width (largeness of the voltage variation).

A description is given of an operation of the semiconductor device constructed as described above. FIG. 4 is a timing chart for exemplifying the operation of the semiconductor device shown in FIG. 3.

Figure 4:
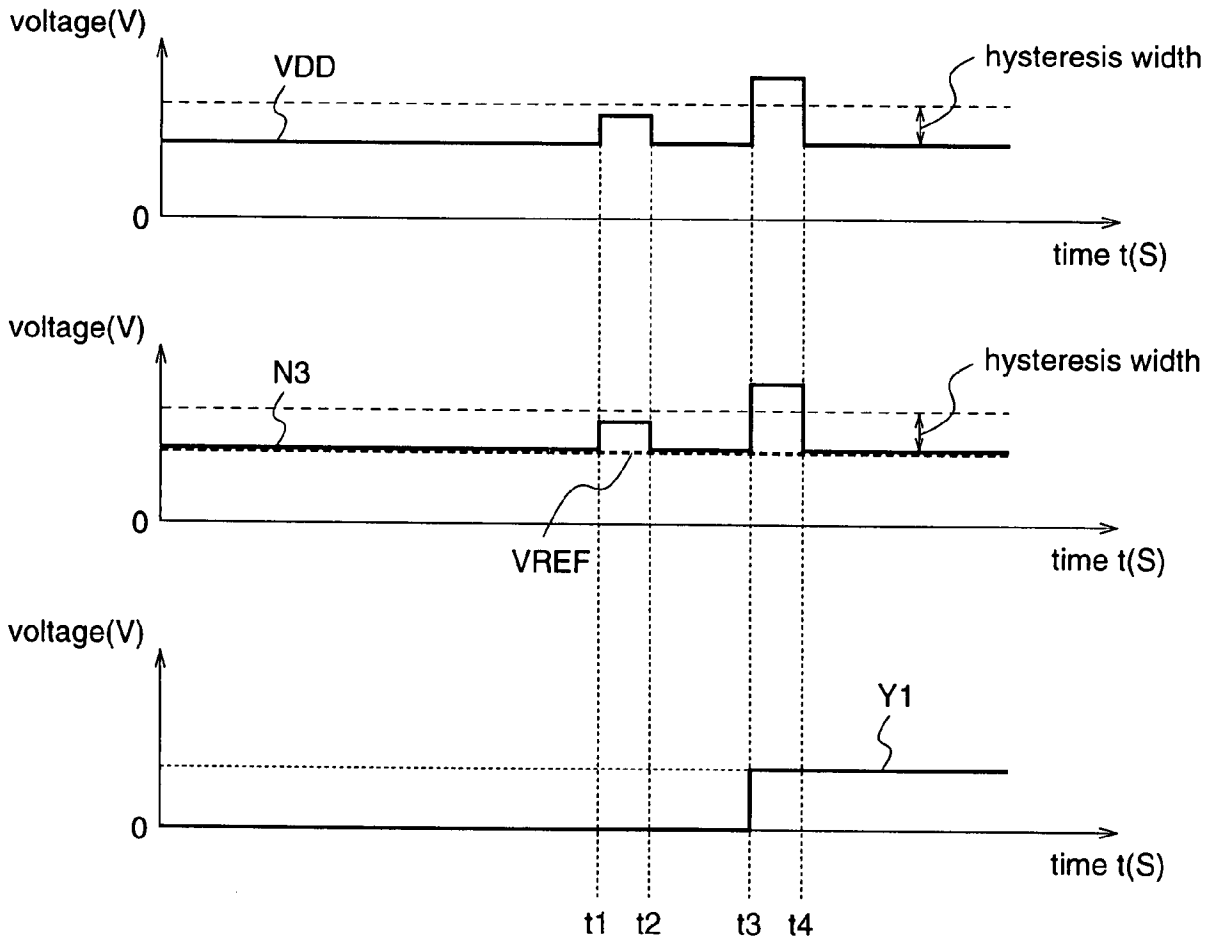
FIG. 4 is a diagram showing a timing chart exemplifying the operation of the semiconductor device according to the second embodiment of the present invention.

In FIG. 4, first of all, the power supply voltage 4 (the power supply voltage VDD) is applied, and a reference voltage VREF is applied to the reference voltage input terminal 5. Then, the voltages which are inputted to the input terminal N3 and the N4, respectively are made equal to each other by the resister element 2.

Next, it is supposed that a positive side voltage variation is generated at the power supply voltage VDD from time t1 to time t2. Then, the voltage variation amount is capacitance-coupled by the capacitance element 3, and thereby the voltage which is inputted from the input terminal N3 to the hysteresis comparator 6 also varies to become a voltage larger than the reference voltage VREF. However, since the voltage difference is smaller than the hysteresis width which is set at the hysteresis comparator 6, the hysteresis comparator 6will not amplify the voltage difference, and as a result, the detected signal Y1 remains being at low level.

Next, it is supposed that a positive side voltage variation which is larger than the hysteresis width which is set at the hysteresis comparator 6 is generated at the power supply voltage VDD during a time period from time t3 to time t4. In this case, the voltage variation component is capacitance-coupled by the capacitance element 3, and thereby the voltage at the input terminal N3 of the hysteresis comparator 6 varies to become a voltage higher than the reference voltage VREF. Then, the detected signal Y1 of this high level is inputted to the reset part (not shown), and this reset part stops the operation of the whole system including the semiconductor device.

As described above, according to the semiconductor device of the second embodiment, the voltage variation from the state where the reference voltage value and the power supply voltage value and the value of the output of the capacitance element 3 are made equal to each other by the resister element 2, is detected by the hysteresis comparator 6. Thereby, the voltage variation can be detected without depending on the power supply voltage before the voltage variation in the power supply voltage should arise. As a result, with relative to the prior art semiconductor device, parameters which should be taken into considerations on designing are reduced, thereby the circuit design is eased. Further, even if a voltage variation which is smaller than the hysteresis width established in the hysteresis comparator 6 is generated, the detected signal Y1 would not become high level. Thereby, it may not arise that the variation in the power supply voltage which does not affect on the operation of the semiconductor device should erroneously be detected as abnormal voltage variation.

While in the above-described second embodiment, an operation of detecting the positive side voltage variation is described, by making the polarity of the input terminal N3 and the input terminal N4 of the hysteresis comparator 6 reverse to each other, i.e., by making the input terminal N3− terminal and the input terminal N4+ terminal, the voltage variation at negative side can be detected.

Embodiment 3

Figure 5:
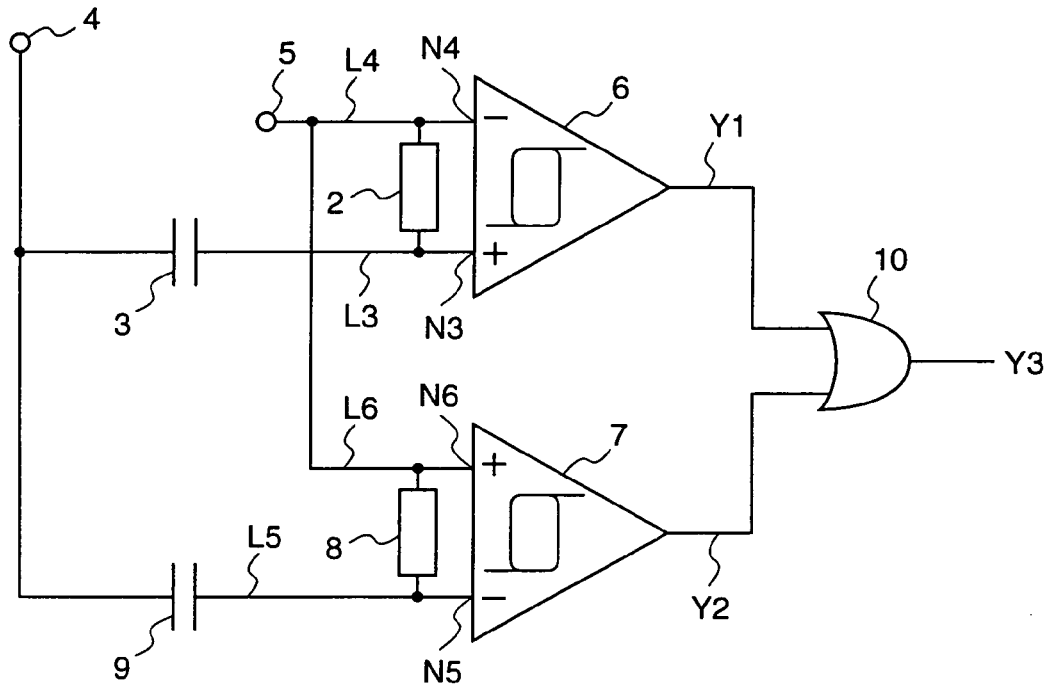
FIG. 5 is a diagram showing gain characteristics of the FIR filter when a weighting value n is changed.

A third embodiment of the present invention will be described with reference to FIGS. 5 and 6. FIG. 5 is a diagram illustrating a circuit construction of a semiconductor device according to the third embodiment of the present invention. The components similar to those in the semiconductor device shown in FIG. 3 are assigned with the same reference numerals.

In the semiconductor devices according to the first and the second embodiment, only either of the voltage variations at the positive side and the negative side is detected. Accordingly, the semiconductor device according to the third embodiment provides a construction in which both of the positive side and negative side voltage variations are detected.

The semiconductor device shown in FIG. 5 includes hysteresis comparators 6 and 7, the resister elements 2 and 8, the capacitance elements 3 and 9, and the logic OR circuit 10. The hysteresis comparator 6 has input terminals (input terminal N3 and N4). The capacitance element 3 has its one side end which is connected to the power supply voltage 4 and its other side end which is connected to one side input terminal (input terminal N3) of the hysteresis comparator 6.

The hysteresis comparator 6 receives the reference voltage and the output of the other side end of the capacitance element 3 to compare those. The hysteresis comparator 7 has input terminals (input terminal N5 and N6). The capacitance element 9 has its one side end which is connected to the power supply voltage 4 and its other side end which is connected to one side input terminal (input terminal N5) of the hysteresis comparator 6. The hysteresis comparator 7 receives the reference voltage and the output of the other side end of the capacitance element 9 to compare those. Here, the polarity of its inputs which receive the output of the other side end of the capacitance element 9 and the reference voltage are made reverse to those in the hysteresis comparator 6. The resister element 2 connects the signal line L3 connected to the input line N3 of the hysteresis comparator 6 and the signal line L4 connected to the input terminal N4 of the hysteresis comparator 6. The resister element 8 connects the signal line L5 connected to the input terminal N5 of the hysteresis comparator 7 and the signal line L6 connected to the input terminal N6 of the hysteresis comparator 7. A logic OR circuit 10 takes a logic OR operation of detected signals Y1, Y2 which are outputted from the hysteresis comparators 6 and 7, to output a detected signal Y3.

The operation of the semiconductor device constructed as above, will be described with reference to FIG. 6. FIG. 6 is a timing chart exemplifying the operation of the semiconductor device shown in FIG. 5.

Figure 6:
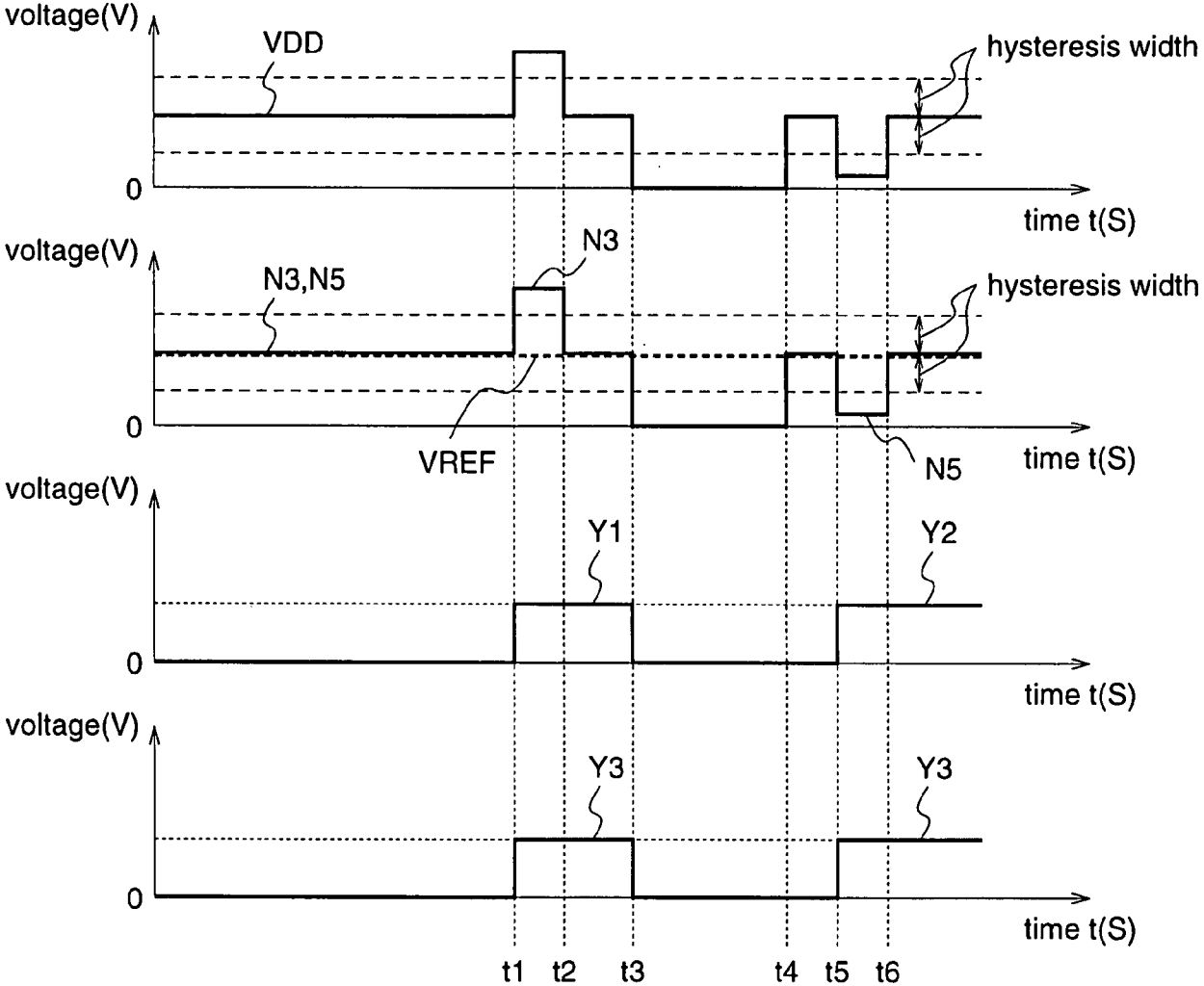
FIG. 6 is a diagram showing a timing chart exemplifying the operation of the semiconductor device according to the third embodiment of the present invention.

In FIG. 6, first of all, at time t0, the power supply voltage 4 (a power supply voltage VDD) is applied, and a reference voltage VREF is applied to the input terminal 5 of the reference voltage.

Next, it is supposed that a positive side voltage variation which is larger than the hysteresis width which is set at the hysteresis comparator 6 is generated at the power supply voltage VDD during from time t1 to time t2. Then, the voltage variation component is capacitance-coupled by the capacitance element 3, and thereby, the voltage which is inputted to the input terminal N3 of the hysteresis comparator 6 also varies to become a voltage higher than the reference voltage VREF. This voltage difference is amplified by the hysteresis comparator 6 to make the detected signal Y1 transit from low level to high level. Then, the logic OR circuit 10 outputs a high level detected signal Y3. This high level detected signal Y3 is inputted to the reset section (not shown), and this reset section stops the operation of the whole system including the semiconductor device at time t3. Accordingly, the voltage becomes 0 V at time t3.

Next, the power supply voltage is again risen at time t4. At time t4, the power supply voltage 4 (the power supply voltage VDD) is applied and the reference voltage VREF 3 is applied to the input terminal for a reference voltage.

Next, when a voltage variation at negative side which is larger than the hysteresis width which is set at the hysteresis comparator 7 is risen at the power supply voltage VDD during a period from time t5 to time t6, the voltage variation is capacitance-coupled by the capacitance element 9, and thereby the voltage at the input terminal N5 of the hysteresis comparator 7 becomes a voltage lower than the reference voltage VREF. This voltage difference is amplified by the hysteresis comparator 7 to make the detected signal Y2 transit from low level to high level. Then, the logic OR circuit 10 outputs a high level detected signal Y3. This high level detected signal Y3 is inputted to the reset section (not shown) and this reset section stops the operation of the whole system including the semiconductor device.

As described above, according to the semiconductor device of the third embodiment of the present invention, the voltage variations at both of the positive side and the negative side from the state where the reference voltage value and the value of the output of the capacitance elements 3 and 9 are made equal to each other by the resister element 2, 8 are detected by the hysteresis comparator 6, 7, respectively. Thereby, the voltage variations at the positive side and negative side can be detected without depending on the power supply voltage before the power supply voltage variation. As a result, with relative to the prior art semiconductor device, parameters which should be taken into considerations on designing are reduced, thereby the circuit design is eased. Further, even if voltage variations at positive side and negative side which are smaller than the hysteresis widths established in the hysteresis comparator 6, 7, respectively, are generated, the detected signal Y3 would not become high level. Thereby, it may not arise that the variations in the power supply voltages which do not affect on the operation of the semiconductor device should erroneously be detected as abnormal voltage variations.

While in the above-described third embodiment, a case where a hysteresis comparator is provided, a normal comparator shown in FIG. 1 may be employed, in place of a hysteresis comparator.

Embodiment 4

Figure 7:
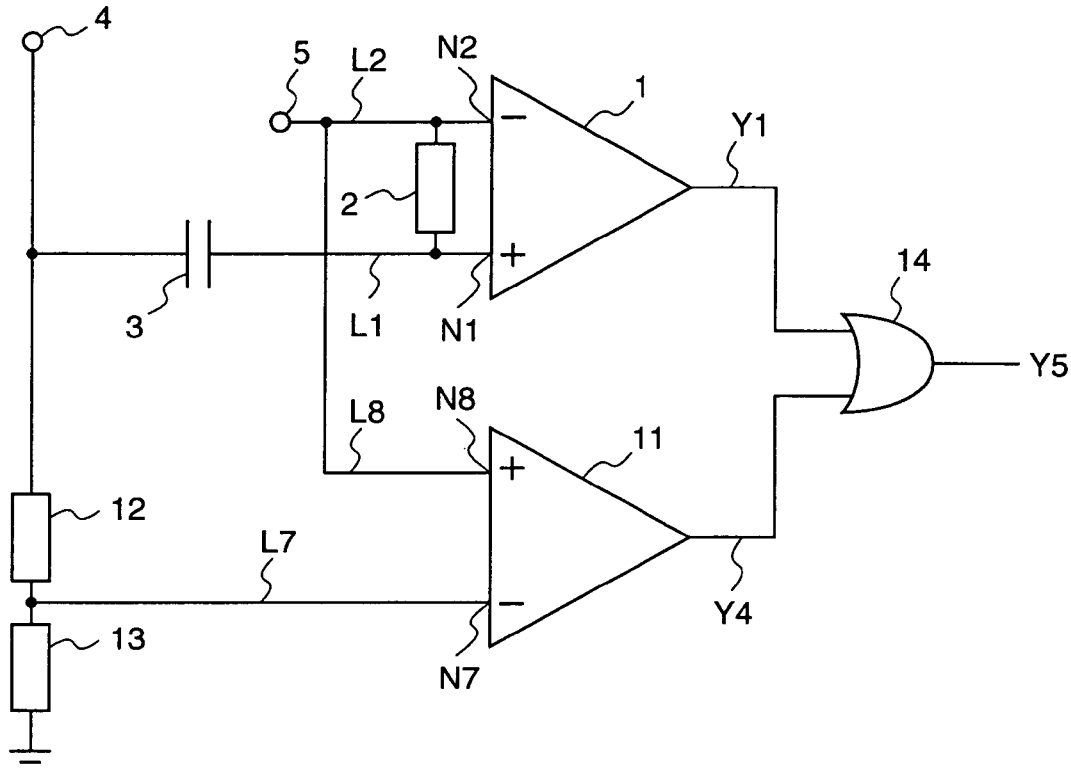
FIG. 7 is a diagram illustrating a circuit construction of a semiconductor device according to a fourth embodiment of the present invention.

A fourth embodiment of the present invention will be described with reference to FIGS. 7 and 8. FIG. 7 is a diagram illustrating a circuit construction of a semiconductor device according to the fourth embodiment of the present invention. The semiconductor device shown in FIG. 7, comprises the semiconductor device shown in FIG. 1 being provided with a voltage variation detection circuit which comprises resister elements 12 and 13 and a comparator 11 having two input terminals, and a logic OR circuit 14.

The resistor elements 12 and 13 divide the power supply voltage. The comparator 11 receives the divided voltage from the one side input terminal N7 and receives the reference voltage from the other side input terminal N8.

The operation of the semiconductor device constituted as above will be described with reference to FIG. 8. FIG. 8 is a timing chart for exemplifying the operation of the operation of the semiconductor device shown in FIG. 7.

Figure 8:
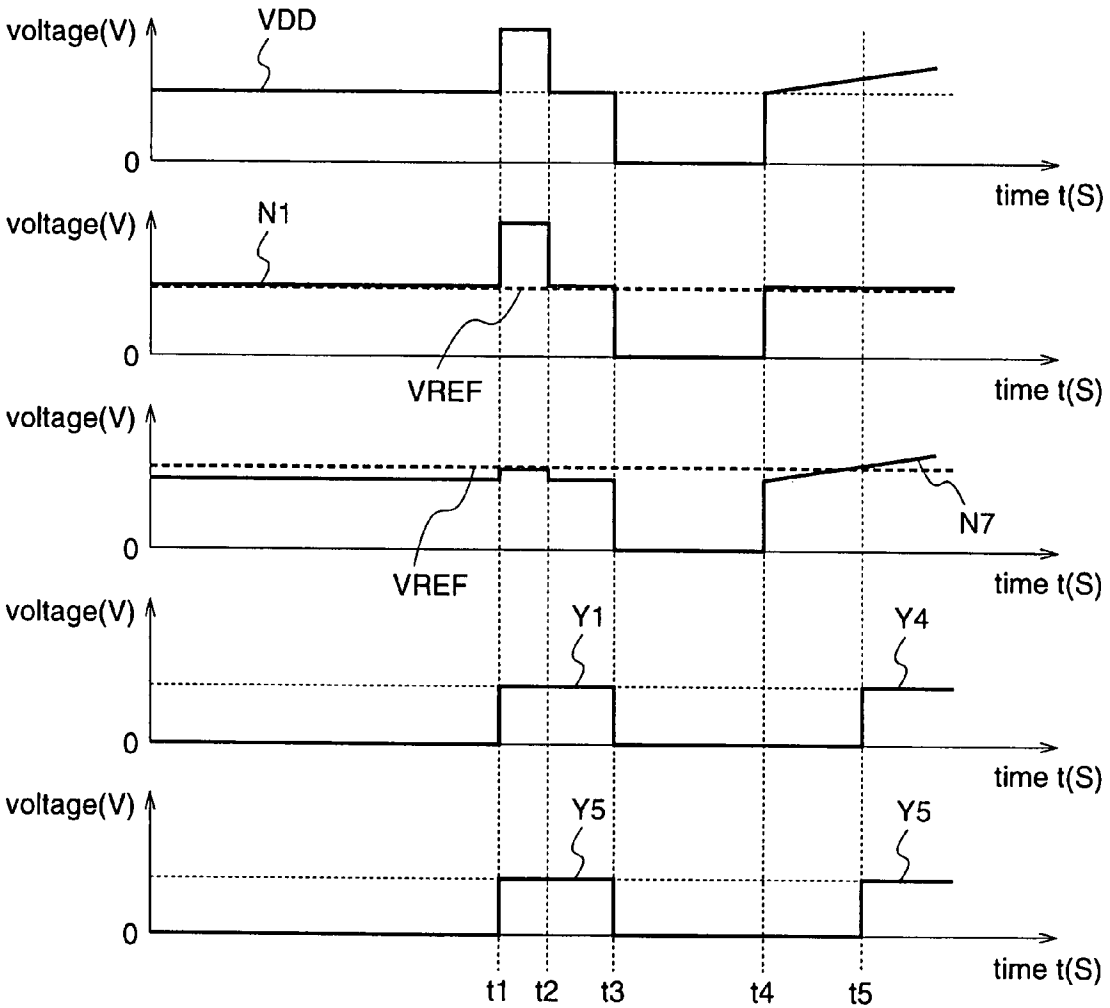
FIG. 8 is a diagram showing a timing chart exemplifying the operation of the semiconductor device according to the fourth embodiment of the present invention.

In FIG. 8, at time t0, the power supply voltage 4 (the power supply voltage VDD) is applied, and a reference voltage is applied to an input terminal for reference voltage 5.

Next, when it is supposed that a positive side voltage variation has occurred at the power supply voltage VDD from t1 to t2, the voltage variation then is capacitance coupled by a capacitance element 3, and thereby, the voltage that is inputted to the input terminal N1 of the comparator 1 varies to become a higher voltage than the reference voltage VREF. This voltage difference is amplified by the comparator 1 and the detected signal Y1 transits from low level to high level. Thereby, a high level detected signal Y5 is outputted from the logic OR circuit 14. The high level detected signal Y5 is inputted to the reset section (not shown), and the reset section stops the operation of the whole system including the semiconductor device at time t3. That is, the voltage becomes 0 V at time t3. On the other hand, since the voltage which is inputted to the input terminal N7 of the comparator 11 is divided by the resister elements 12 and 13, the steep voltage variation from time t1 to time t2 cannot be detected by the comparator 11.

Next, the power supply voltage is again risen up at time t4. Then, the power supply voltage 4 (the power supply voltage VDD) is applied, and a reference voltage VREF is applied to the input terminal for reference voltage 5.

Next, when it is supposed that the voltage VDD gradually rises up from time t4 to time t5, the voltage which is divided by the resister elements 12 and 13 also rises up, to become a voltage higher than the reference voltage VFF. This voltage difference is amplified by the comparator 11 and the detected signal Y4 transits from low level. Thereby, a high level detected signal Y5 is outputted from the logic OR circuit 14, to be inputted to the reset section. Besides, the value of the output of the capacitance element 3 and the reference voltage which are inputted to the comparator 1 are made the same voltages by the resister element 2, and therefore, the comparator 1 cannot detect the smooth voltage change which arises from time t4 to time t5.

As described above, the semiconductor device according to the fourth embodiment of the present invention, the voltage variation from the state where the reference voltage value and the value of the output of the capacitance element 3 are made the same values by the resister element 2 is detected, and therefore, it is possible to detect a steep voltage variation can be detected without dependent on the power supply voltage value before the voltage variation arises. Consequently, with relative to the prior art semiconductor device, parameters which should be taken into considerations on designing are reduced, and the circuit design is eased. Further, since the resister elements 12 and 13, and the comparator 11 which compares the divided voltage and the reference voltage are provided, a smooth voltage variation can also be detected.

While in the above-described fourth embodiment a case where the voltage variation detecting circuit comprising the comparator 11 and the resister elements 12 and 13 are added to the semiconductor device of the first embodiment, the present invention is not limited thereto, and the voltage variation detecting circuit may be provided in the semiconductor device of the second embodiment and the third embodiment.

Further, when the voltage variation at the negative side is to be detected, the polarities of the input terminals N1, N2, and N7, N8 of the comparator 1 and 11 may be reversed respectively.

Embodiment 5

Figure 9:
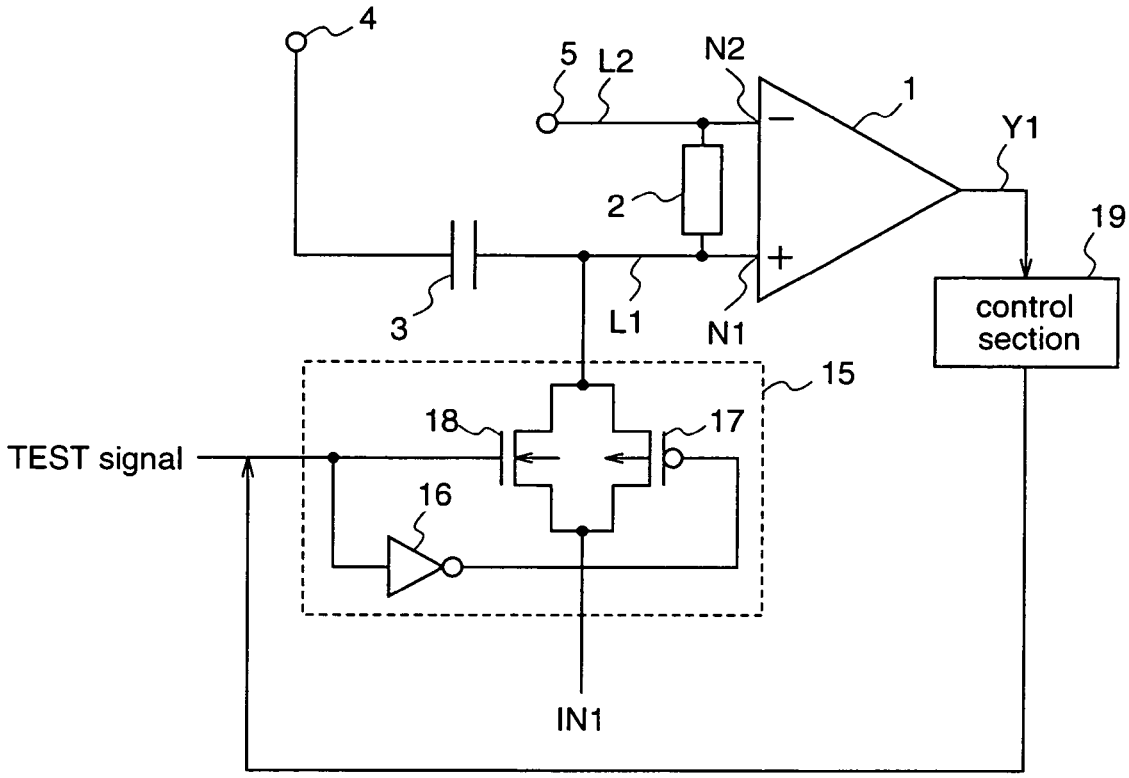
FIG. 9 is a diagram illustrating a circuit construction of a semiconductor device according to a fifth embodiment of the present invention.
Figure 10:
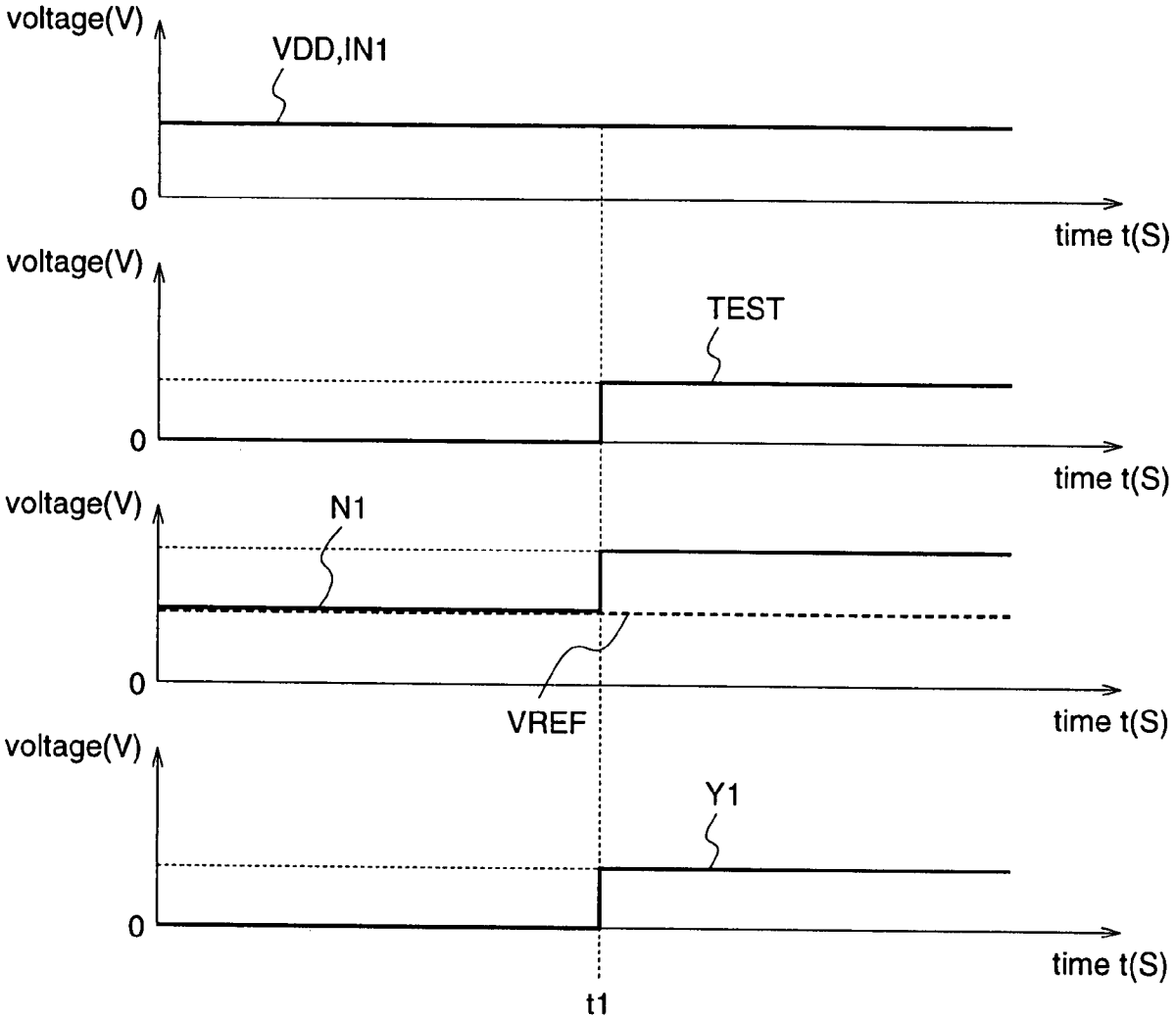
FIG. 10 is a diagram showing a timing chart exemplifying the operation of the semiconductor device according to the fifth embodiment of the present invention.
Figure 11:
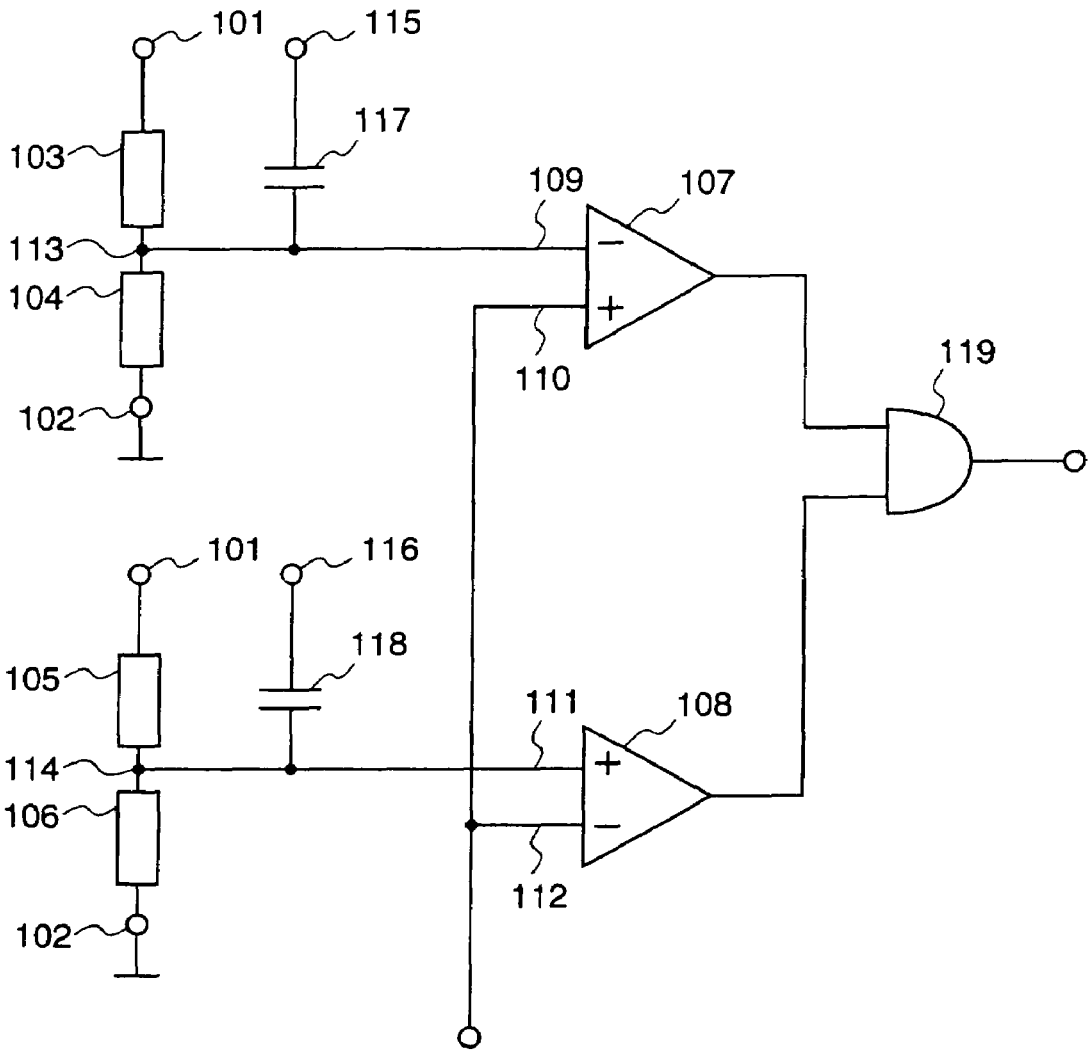
FIG. 11 is a diagram illustrating a circuit construction of a prior art semiconductor device having a power supply voltage variation detecting circuit.
Figure 12:
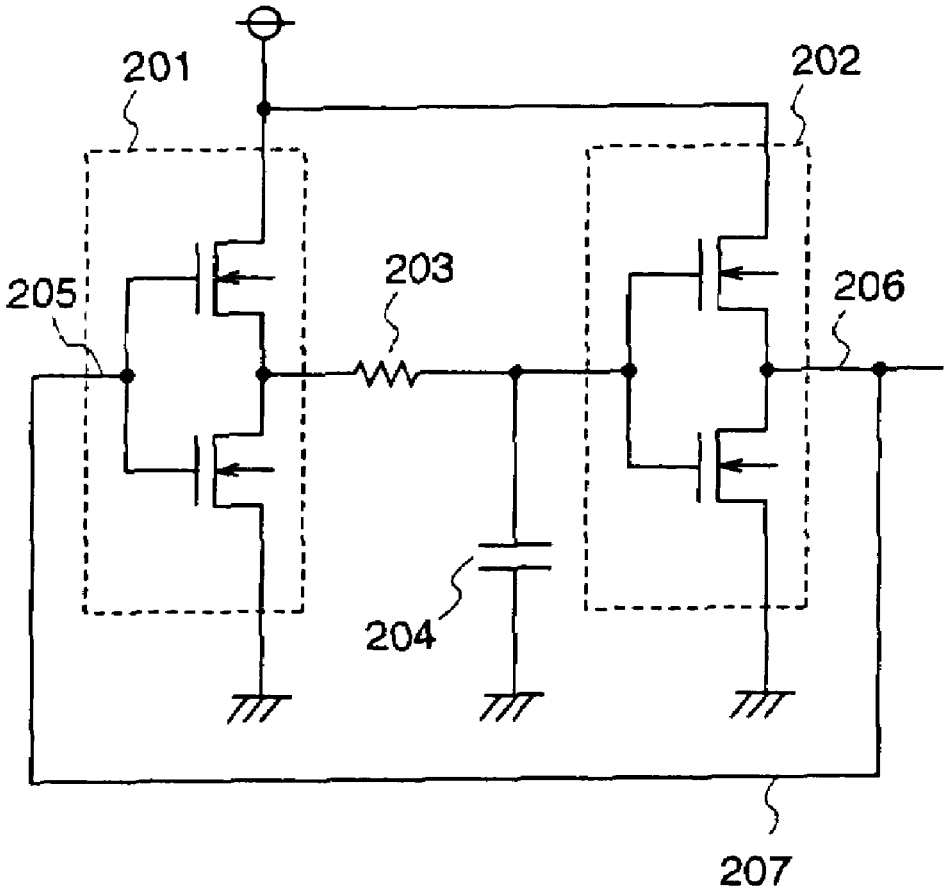
FIG. 12 is a diagram illustrating a circuit construction of a prior art semiconductor device having a power supply voltage variation detecting circuit.

A fifth embodiment of the present invention will be described with reference to FIGS. 9 and 10. FIG. 7 is a diagram illustrating a circuit construction of a semiconductor device according to the fifth embodiment of the present invention. The semiconductor device shown in FIG. 9, comprises the semiconductor device shown in FIG. 1 being provided with a switching section 15 and a control section 19.

The switching section 15 includes an inverter 16, a p channel transistor 17, and an n channel transistor 18. The output of the inverter 16 is connected to the gate of the p channel transistor 17. The sources of the p channel transistor 17 and the n channel transistor 18 are connected to the input IN1 and the drains thereof are connected to the input terminal N1 of the comparator 1. The switching section 15 constituted as above switches the voltage value which is inputted to the input terminal N1 of the comparator 1 to an arbitrary value, that is, an arbitrary voltage value which is inputted to the input terminal IN1.

The control section 19 makes the switching section 15 operate by making a test (TEST) signal high, and receives the detected signal Y1 of the comparator 1 to detect as to whether that signal is activated or not.

For example, the control section 19 makes the TEST signal high each time when the power supply voltage of the semiconductor device is turned on, and then the switching section 15 makes the voltage value which is inputted to the input terminal N1 higher than the reference voltage value. Then, whether the comparator 1 has detected that voltage difference and outputted a high level detected signal Y1 or not, is detected by the control section 19.

By constituting the semiconductor device as described above, it is possible to confirm whether the comparator 1 is operating normally or not.

The operation of the semiconductor device constituted as described above will be described with reference to FIG. 10. FIG. 10 shows a timing chart for explaining the operation of the semiconductor device.

First of all, at time t0, a the power supply voltage 4 (the power supply voltage VDD) is applied, and a reference voltage is applied to an input terminal for reference voltage is applied to an input terminal for reference voltage 5. Then, the voltage which is inputted to the input terminals N1 and N2 of the comparator 1 are made equal to each other by the resister element 2.

Next, when the control section 19 makes the test signal which is inputted to the switching section 15 from a low level to a high level at time t1, the p channel transistor 17 and the n channel transistor 18 are turned on, and an arbitrary voltage which is inputted to the input terminal IN1 (hereinafter referred to as "an arbitrary voltage IN1"), i.e., a voltage which is higher than the reference voltage VREF is inputted to the input terminal N1 of the comparator 1. Then, if the comparator 1 is operating normally, the voltage difference between the reference voltage VREF and the arbitrary voltage IN1 is amplified by the comparator 1 and the detected signal Y1 transits from low level to high level. Whether the detected signal Y1 has become high level accompanying that the voltage of the input terminal N1 has become a higher voltage than the reference voltage VREF is confirmed by the control section 19 by inputting the detected signal Y1.

As described above, the semiconductor device of the fifth embodiment of the present invention is provided with a switching section 15 which makes an arbitrary voltage inputted to a terminal for receiving the output of the capacitance element 3 in the comparator, and thereby it can detect whether the comparator is normally operating or not.

While in this fifth embodiment a case where the voltage which is inputted to the input terminal N1 by the switching section 15 is switched to a voltage higher than the reference voltage, the present invention is not limited thereto. For example, it may be possible to make the input terminal N1− terminal, and the input terminal N2+ terminal, and switch the voltage which is inputted to the input terminal N1 to a voltage lower than the reference voltage.

While in the fifth embodiment the control section 19 in the semiconductor device makes the TEST signal high thereby to operate the switching section 15, and receive the detected signal Y1 of the comparator 1 as its input to detect where that signal is activated or not, the present invention is not limited thereto. For example, an external apparatus may control the switching section 15 to make the detected signal Y1 of the comparator 1 inputted to the control section to detect whether the signal is activated or not.

While in the fifth embodiment the semiconductor device of the first embodiment is provided the switching section 15 and the control section 19, the present invention is not limited thereto. For example, the semiconductor device shown in the second to fourth embodiment may; be additionally provided with the switching section 15 and the control section 19. Then, the value of the output of the capacitance element which is inputted to the one-side input terminal of the respective comparators are switched to an arbitrary voltage by the switching section 15.

Further, while in the above-described second to fourth embodiment the resister elements are made those which connect two signal lines which are connected to the two input terminals of the comparator with each other, the two input terminals of the comparator may be connected to each other via only one of the two signal lines, or the two input terminals may be directly connected to each other.

APPLICABILITY IN INDUSTRY

The semiconductor device according to the present invention can detect a steep change of the voltage difference between the power supply voltage and the ground voltage, and therefore, it is suitable in being applied in an LSI which can take a countermeasure against attacks to the semiconductor device such as data falsification or unjustified reading out from the outside.

The invention claimed is:

1. A semiconductor device, comprising:

a capacitance element having one end connected to a power supply, the capacitance element for detecting a voltage variation of the power supply;

a first comparator having two input nodes having opposite polarities to each other, a first input node of the two input nodes for receiving a reference voltage and a second input node of the two input nodes connected to an output of the other end of the capacitance element to compare the respective voltage values to output a first output signal indicating a comparison result, such that the capacitance element is connected in series with the power supply and the second input node;

a first resistor element connecting the first input node and the second input node of the first comparator;

a second resistor element having a first end directly connected to said power supply;

a third resistor element having a first end connected to a second end of the second resistor and having a second end directly connected to a ground terminal;

a second comparator having two input nodes directly connected to the first end of the third resistor element and the reference voltage terminal, respectively, and for outputting a second output signal indicating a second comparison result;

a logic OR circuit which performs a logic OR operation of the first output signal of the first comparator and the second output signal of the second comparator; and a reset circuit for receiving an output signal of the logic OR circuit, and for halting operation of a system including the semiconductor device when the output signal of the OR circuit is activated;

wherein the first comparator is for outputting a first output signal indicating the comparison result when a predetermined voltage difference exists between the inputted reference voltage and the inputted output of the other end of the capacitance element.

2. A semiconductor device as defined in claim 1, wherein:

the first comparator is a hysteresis comparator for outputting the first output signal indicating the first comparison result when the voltage difference between the inputted reference voltage and the output of the other end of the capacitance element becomes larger than a predetermined hysteresis width.

3. A semiconductor device as defined in claim 1, further comprising a switching part for switching a value of the output of the other end of the capacitance element to an arbitrary value.

4. A semiconductor device as defined in claim 3, further comprising a control section which operates the switching part at turning on the power of the semiconductor device.

5. A semiconductor device comprising:

a first capacitance element and a second capacitance element, one end of each of which is connected to a separate power supply, the first and second capacitance elements for detecting a voltage variation of each power supply;

a first comparator having input nodes, the input nodes having opposite polarities and receiving a reference voltage and an output of the other end of the first capacitance element at their inputs to compare the respective voltage values to output a first signal indicating a first comparison result;

a second comparator which has two input nodes, the input nodes having opposite polarities and receiving a reference voltage and an output of the other end of the second capacitance element at their inputs to compare the respective voltage values to output a second signal indicating a second comparison result;

a first resistor element and a second resistor element each of which connects the one side input node and the other side input node of the first and the second comparators, respectively;

a logic OR circuit for performing a logic OR operation of the first output signal of the first comparator and the second output signal of the second comparator;

wherein the first and the second comparators output the first and second output signals, respectively, when a voltage difference is detected between inputted reference voltage and the inputted output of the other end of the respective first and second capacitance element, and the polarity of the input node which receives the output of the other end of the first capacitance element in the first comparator and the polarity of the input node which receives an output of the other end of the second capacitance element in the second comparator are opposite to each other.

6. A semiconductor device as defined as defined in claim 5 wherein:

the first comparator and the second comparator are hysteresis comparators which output the first and second output signals indicating the respective comparison results when a voltage difference between the inputted reference voltage and the inputted output of the other end of the first and second capacitance element, respectively, is larger than a predetermined hysteresis width.

* * * * *